US007815179B2

(12) United States Patent
Taguchi et al.

(10) Patent No.: US 7,815,179 B2
(45) Date of Patent: Oct. 19, 2010

(54) SHEET FINISHING APPARATUS AND CONTROL METHOD

(75) Inventors: Hiroyuki Taguchi, Shizuoka (JP); Tetsuhiro Morita, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 210 days.

(21) Appl. No.: 12/212,807

(22) Filed: Sep. 18, 2008

(65) Prior Publication Data

US 2009/0102112 A1 Apr. 23, 2009

Related U.S. Application Data

(60) Provisional application No. 60/980,726, filed on Oct. 17, 2007, provisional application No. 60/980,729, filed on Oct. 17, 2007.

(51) Int. Cl.
*B65H 37/04* (2006.01)

(52) U.S. Cl. ..... 270/52.17; 270/58.07; 270/30.08; 493/444; 493/445

(58) Field of Classification Search ..... 270/52.17, 270/58.07, 5.02, 21.1, 30.08
See application file for complete search history.

(56) References Cited

U.S. PATENT DOCUMENTS 6,361,036 B1 * 3/2002 Nakazawa ..... 270/58.07
7,077,393 B2 * 7/2006 Ishida ..... 270/37
7,578,498 B2 * 8/2009 Iguchi et al. ..... 270/58.07
7,669,842 B2 * 3/2010 Smith ..... 270/58.07
2003/0080487 A1 * 5/2003 Tamura et al. ..... 270/58.07
2008/0308988 A1 * 12/2008 Iguchi et al. ..... 270/58.07
2008/0308989 A1 * 12/2008 Iguchi et al. ..... 270/58.07
2009/0102112 A1 * 4/2009 Taguchi et al. ..... 270/58.07
2009/0218745 A1 * 9/2009 Kushida et al. ..... 270/58.07
2010/0007071 A1 * 1/2010 Hayashi ..... 270/21.1

FOREIGN PATENT DOCUMENTS

JP 11-92020 4/1999
JP 2000-001256 1/2000
JP 2002-68577 A 3/2002
JP 2005-156722 6/2005

* cited by examiner

*Primary Examiner*—Patrick Mackey
(74) *Attorney, Agent, or Firm*—Patterson & Sheridan, LLP

(57) ABSTRACT

A sheet finishing apparatus includes a punch unit to punch a sheet, and a saddle unit to bundle and to fold the sheets. A position and an inclination angle of a puncher are changed according to a skew amount of the sheet, the puncher is controlled to form punch holes in the sheet at positions symmetric with respect to a folding line, and punching is performed so that an interval between the folding line and the punch hole becomes small at the inside of a bundle of the sheets and becomes large at the front cover side.

15 Claims, 15 Drawing Sheets

SHEET FINISHING APPARATUS AND CONTROL METHOD

CROSS-REFERENCE TO RELATED APPLICATION

This application is based upon and claims the priority of U.S. Provisional Application No. 60/980,726, filed on Oct. 17, 2007, and U.S. Provisional Application No. 60/980,729, filed on Oct. 17, 2007, the entire contents of which are incorporated herein by reference.

TECHNICAL FIELD

The present invention relates to a sheet finishing apparatus to perform finishing on a sheet discharged from an image forming apparatus such as a copier, a printer or a multi-function peripheral (MFP) and a control method of the same, and particularly to an improvement of a punch unit to punch a punch hole in a sheet.

BACKGROUND

In recent years, in an image forming apparatus (for example, an MFP), a sheet finishing apparatus is provided adjacently to a latter stage of the MFP in order to perform finishing on a sheet after image formation. The sheet finishing apparatus is called a finisher, and punches a punch hole in the sheet sent from the MFP or staples it. Or, in some finishers, a sheet bundle is folded and is discharged.

In a finisher including a sheet folding unit, after a punch hole is formed, folding is performed. When a sheet bundle becomes thick, since the position of the punch hole shifts between a sheet at the front cover side and a sheet at the inside, the punch position is shifted between the front cover side and the inside.

JP-A-2000-1256 discloses a punch apparatus. In this example, punch holes are punched symmetrically with respect to the center position of a sheet, an interval between the punch holes is made small for the sheet at the inside of a sheet bundle, and an interval between the punch holes is made large for the sheet at the front cover side.

However, in the punch apparatus as stated above, a sheet can move obliquely (hereinafter called skew) with respect to a conveyance direction of a sheet, and when punching is performed while the skewing is occurring, the punching position is obliquely shifted, and a trouble occurs when filing is performed.

SUMMARY

It is an object of the present invention to provide a sheet finishing apparatus which can punch a punch hole at an accurate position even if a sheet is skewed.

According to an aspect of the present invention, a sheet finishing apparatus comprising;

a skew detector to detect a skew amount of a conveyed sheet;

a punch unit that includes a puncher disposed downstream of the skew detector and punches a hole in the sheet;

a drive mechanism to change a position of the puncher with respect to a conveyance path of the sheet and an inclination angle of the puncher with respect to the conveyance path of the sheet;

a saddle unit that is disposed downstream of the puncher and forms folds along folding lines of a plurality of the punched sheets; and a controller that drives the drive mechanism to change the position and the inclination angle of the puncher according to the detected skew amount and to punch holes at positions axisymmetric with respect to the folding line.

DETAILED DESCRIPTION

Figure 1:
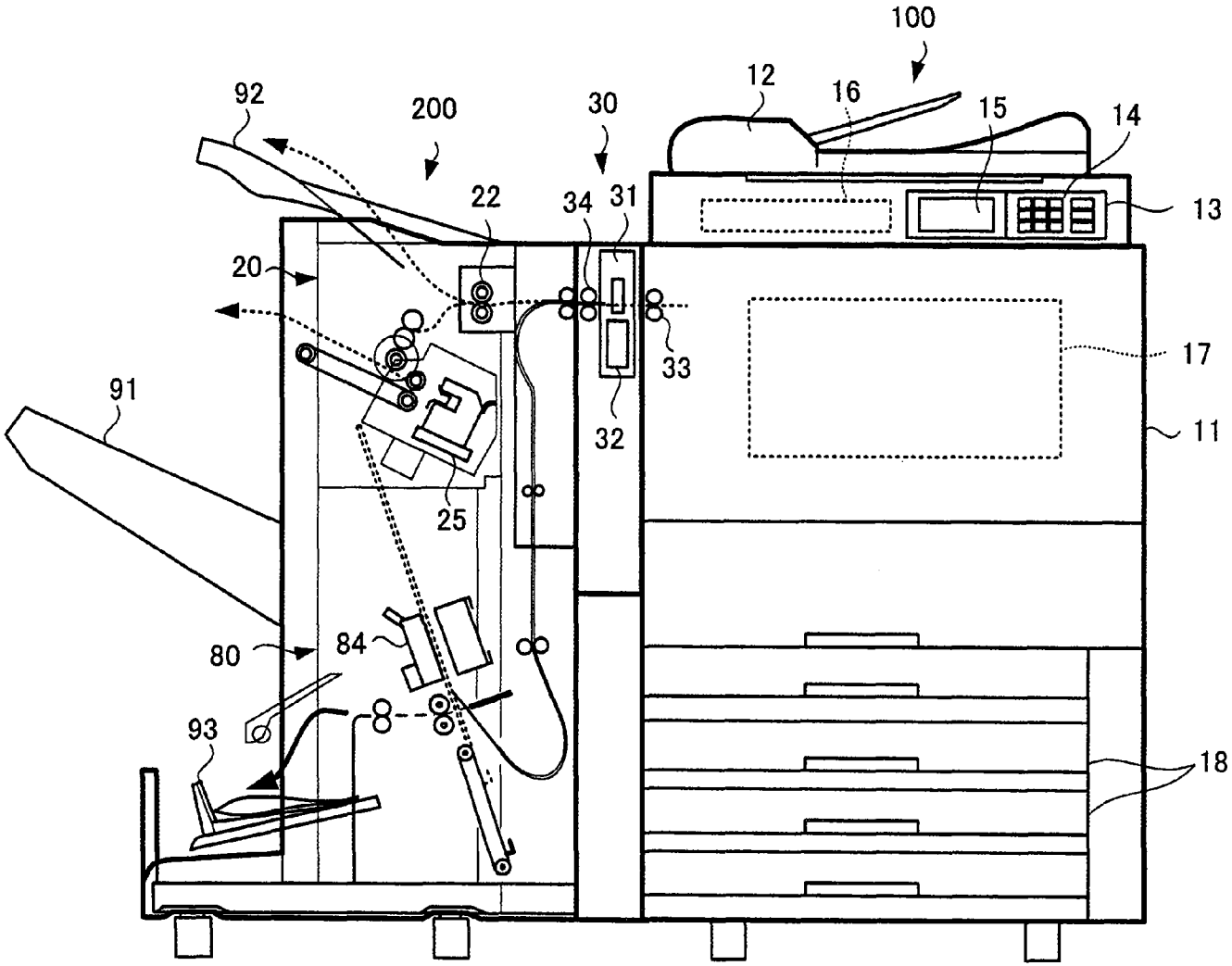
FIG. 1 is a whole structural view of a sheet finishing apparatus.

Throughout this description, the embodiments and examples shown should be considered as exemplars, rather than limitations on the apparatus of the present invention.

Hereinafter, an embodiment will be described with reference to the drawings. In the respective drawings, the same portion is denoted by the same reference numeral and the description thereof will be made.

FIG. 1 is a structural view showing an embodiment of a sheet finishing apparatus. In FIG. 1, reference numeral 100 denotes an image forming apparatus, which is, for example, an MFP (Multi-Function Peripherals) as a compound machine, a printer, a copier or the like. A sheet finishing apparatus 200 is disposed adjacently to the image forming apparatus 100. A sheet on which an image is formed by the image forming apparatus 100 is conveyed to the sheet finishing apparatus 200.

The sheet finishing apparatus 200 performs finishing on the sheet supplied from the image forming apparatus 100, and performs, for example, punching, sorting, stapling and the like. Besides, as the need arises, the sheet is folded and is discharged. The sheet finishing apparatus 200 is called a finisher 200 in the following description.

In FIG. 1, a document table is provided at an upper part of a main body 11 of the image forming apparatus 100, and an auto document feeder (ADF) 12 is openably and closably provided on the document table. Further, an operation panel 13 is provided at an upper part of the main body 11. The operation panel 13 includes an operation section 14 having various keys and a touch-panel display section 15.

A scanner section 16 and a printer section 17 are provided in the inside of the main body 11, and further, plural cassettes 18 containing various sizes of sheets are provided at a lower part of the main body 11. The scanner unit 16 reads an original document sent by the ADF 12 or an original document put on the document table.

The printer unit 17 includes a photoconductive drum, a laser and the like. The surface of the photoconductive drum is scanned and exposed with a laser beam from the laser, and an electrostatic latent image is formed on the photoconductive drum. A charger, a developing unit, a transfer unit and the like are disposed around the photoconductive drum. The electrostatic latent image on the photoconductive drum is developed by the developing unit, and a toner image is formed on the photoconductive drum. The toner image is transferred to a sheet by the transfer unit. The structure of the printer 17 is not limited to the foregoing example, and there are various systems.

A sheet on which an image is formed by the main body 11 is conveyed to the finisher 200. In the example of FIG. 1, the finisher 200 includes a staple unit 20 to staple the sheet bundle, a punch unit 30 to punch a punch hole in the sheet, and a saddle unit 80 to fold a sheet bundle. The sheet subjected to the finishing by the finisher 200 is discharged to a storage tray 91 or a fixed tray 92.

The storage tray 91 moves up and down, and receives a punched or stapled sheet bundle. Besides, the staple unit 20 includes an aligning device to align the conveyed sheet in the width direction, and the sheet can be sorted and discharged by using the aligning device. When the finishing is not performed, the sheet conveyed from the main body 11 is directly discharged to the storage tray 91 or the fixed tray 92.

Figure 2:
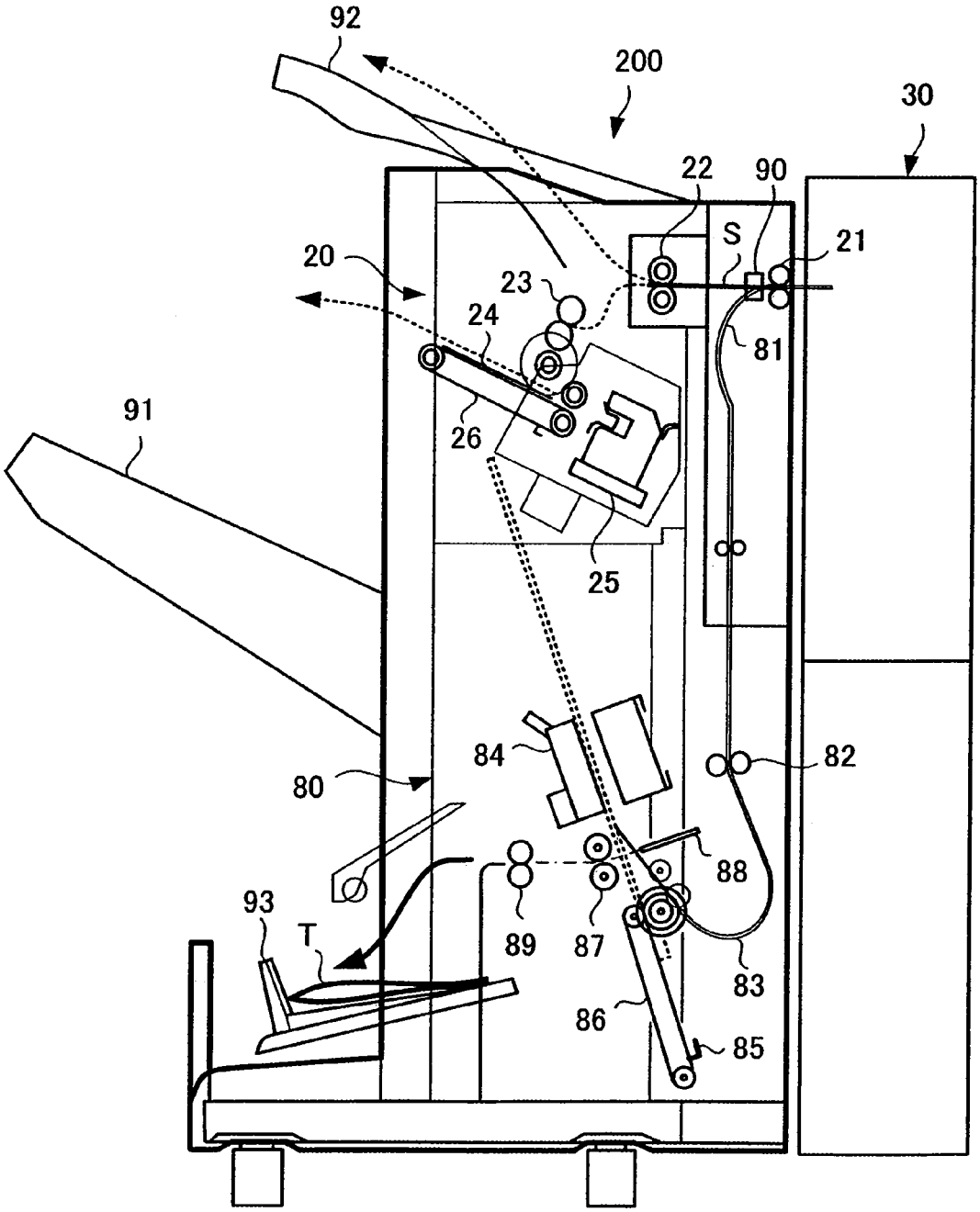
FIG. 2 is a structural view showing a staple unit and a saddle unit under magnification.

FIG. 2 shows a structure of the staple unit 20 and the saddle unit 80 of the finisher 200 under magnification. First, the staple unit 20 will be described in brief. A sheet S supplied from the punch unit 30 is received by an inlet roller 22 of the staple unit 20 through a conveyance roller 21. A paper feed roller 23 is disposed downstream of the inlet roller 22, and the sheet S received by the inlet roller 22 is loaded on a processing tray 24 through the paper feed roller 23.

The sheet loaded on the processing tray 24 is guided to the stapler 25 and is stapled. Besides, a conveyance belt 26 to convey the sorted or stapled sheet S to the storage tray 91 is provided.

The sheet S conveyed by the conveyance belt 26 is discharged to the storage tray 91, and the storage tray 91 moves up and down and receives the sheet S.

There is also a case where the sheet S is discharged to the storage tray 91 without being stapled. In this case, the sheet S is discharged without being dropped to the processing tray 24. Besides, the sheet S which does not require the finishing can also be discharged to the fixed tray 92. There is a conveyance path for guiding the sheet S to the fixed tray 92.

A structure of the saddle unit 80 will be described.

The saddle unit 80 is disposed downstream of the punch unit 30 and is a device that bundles plural punched sheets and folds the plural punched sheets. The sheet can be folded without being punched. The sheet S discharged from the punch unit 30 is conveyed by a roller 82 through a paper path 81. Although the sheet is further conveyed in a direction of a stapler 84 through a paper path 83. The sheet is once received by a stack tray 85 in front of the stapler 84. The sheets S are sequentially stacked on the stack tray 85 and become a sheet bundle T.

The sheet bundle T on the stack tray 85 is conveyed in the direction of the stapler 84 by a guide belt 86, and when the center of the sheet bundle T reaches the stapler 84, the guide belt 86 is once stopped, and stapling is performed at the center of the sheet bundle T.

The sheet bundle T stapled by the stapler 84 is moved down by the guide belt 86, and when the center of the sheet bundle T reaches a nip point of a fold roller pair 87, the sheet bundle is stopped. A blade 88 is disposed at a position opposite to the fold roller pair 87.

The blade 88 thrusts the center of the sheet bundle T to the nip point of the fold roller pair 87, and pushes the sheet bundle T into between the fold roller pair 87. Thereafter, the fold roller pair 87 rotates while folding and nipping the sheet bundle T, and folds the sheet bundle T. The folded sheet bundle T is further firmly folded by a conveyance roller pair 89, and is discharged to a storage tray 93.

A gate 90 is provided at an outlet of the roller 21, and switches and conveys the sheet S supplied from the punch unit 30 to the staple unit 20 side or the saddle unit 80 side. When the sheet S is not folded, the gate 90 conveys the sheet S to the inlet roller 22 of the staple unit 20. When folded, the sheet S is conveyed to the saddle unit 80.

Figure 3:
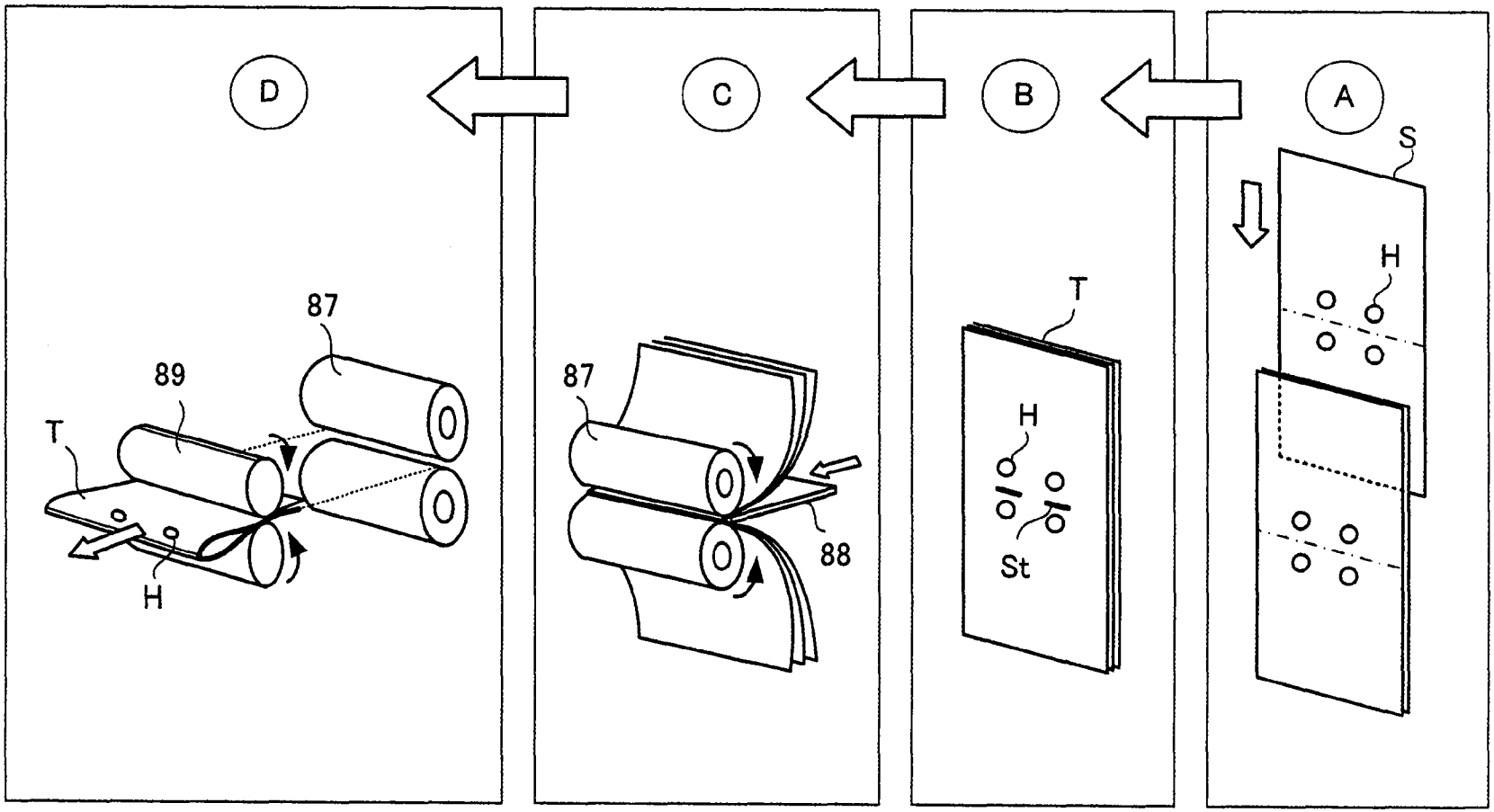
FIG. 3 is an operation explanatory view of a finisher.

FIG. 3 is a view for explaining an operation of the finisher 200, and the sheet S is processed in the sequence of A to D. In FIG. 3, the sheet S discharged from the image forming apparatus 100 is sent to the punch unit 30, and as shown in A of FIG. 3, the punch unit 30 punches punch holes H symmetrically with respect to the center of the sheet S. The punched sheet S is received by the stack tray 85 before being sent to the stapler 84. As a result, the sequentially conveyed sheets S are stacked on the stack tray 85 and become the sheet bundle T.

The sheet bundle T is conveyed to the stapler 84 by the guide belt 86, and the stapler 84 staples (St) the center of the sheet bundle T. The stapled sheet bundle T is shown in B of FIG. 3.

Thereafter, the sheet bundle T is moved down by the guide belt 86. When the center of the sheet bundle T reaches the nip point of the fold roller pair 87, the blade 88 thrusts the center of the sheet bundle T to the nip point of the fold roller pair 87 as shown in C of FIG. 3, and pushes the sheet bundle T into between the fold roller pair 87.

The roller pair 87 rotates so as to draw in the sheet bundle T, and the sheet bundle T is folded. As shown in D of FIG. 3, the folded sheet bundle T is conveyed by the discharge roller pair 89 and is discharged to the storage tray 93. The punch holes H of the folded sheet bundle T overlap with each other.

The punch unit 30 will be described. As shown in FIG. 1, the punch unit 30 is disposed between the main body 11 and the staple unit 20, and includes a punch box 31 and a dust box 32.

The punch box 31 includes a punching blade to punch a sheet. The punching blade moves down to punch a punch hole in the sheet. Punch dust generated by punching falls onto the dust box 32.

Plural rollers 33 and 34 for sheet conveyance exist on a path from the main body 11 to the staple unit 20. The roller 33 is supported by the main body 11, and the roller 34 exists at the final outlet of the punch unit 30. The sheet discharged from the main body 11 is conveyed to the punch unit 30 by the roller 33, and is conveyed to the staple unit 20 by the roller 34. The punching by the punch unit 30 is performed when the user operates the operation panel 13 to set a punch mode.

Figure 4:
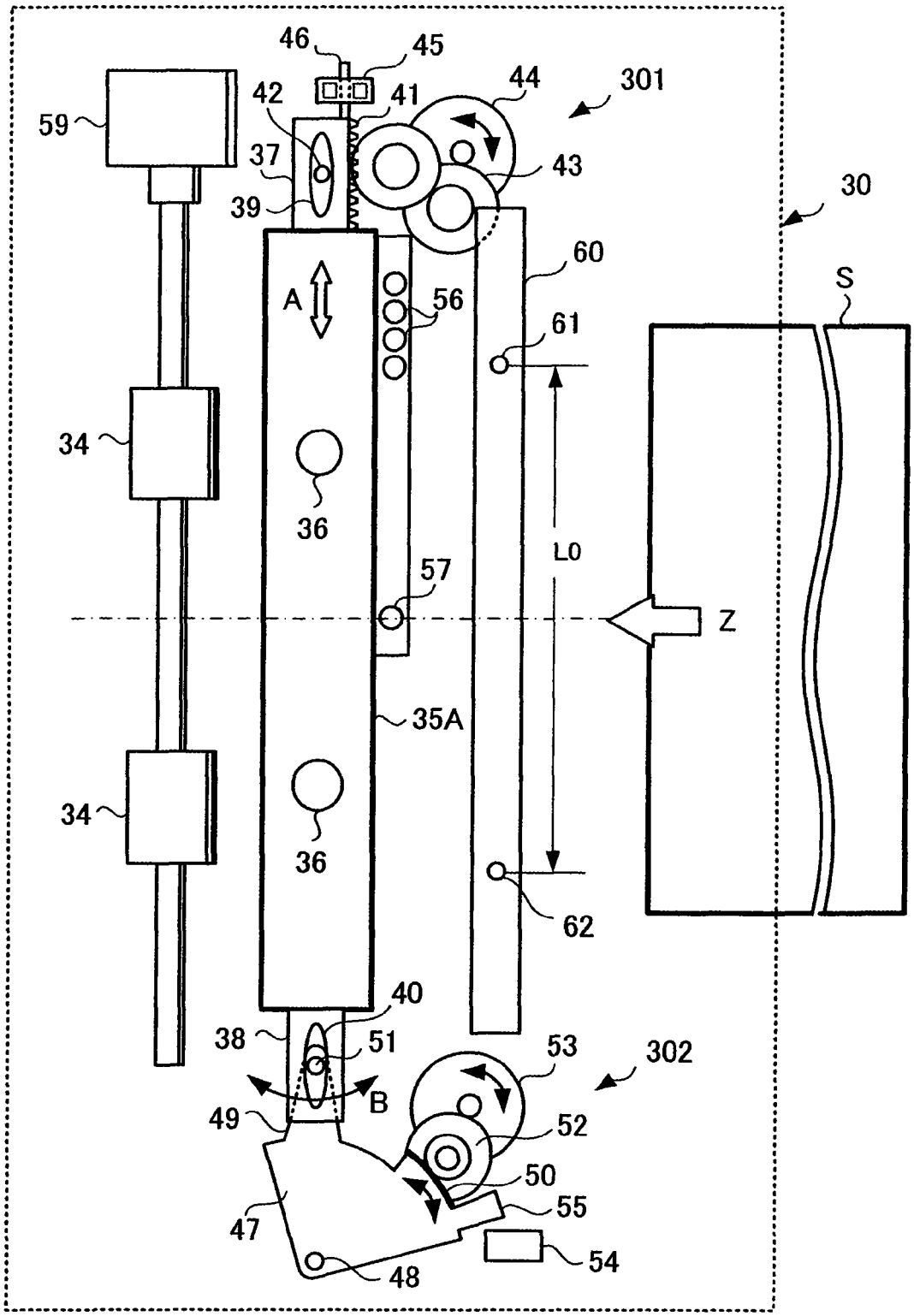
FIG. 4 is plan view of a punch unit.

FIG. 4 shows a specific structure of the punch unit 30.

The punch unit 30 has a function to punch a punch hole in the sheet S and a function to correct a skew of the sheet S. The punch unit 30 includes a puncher 35A to punch a punch hole in the sheet S carried in from the main body 11, and a skew detection section 60 to detect the skew. The puncher 35A is provided downstream of the skew detection section 60.

The skew detection section 60 and the puncher 35A are orthogonal to a conveyance direction Z of the sheet S. The puncher 35A includes plural (two in FIG. 4) punching blades 36.

Figure 5:
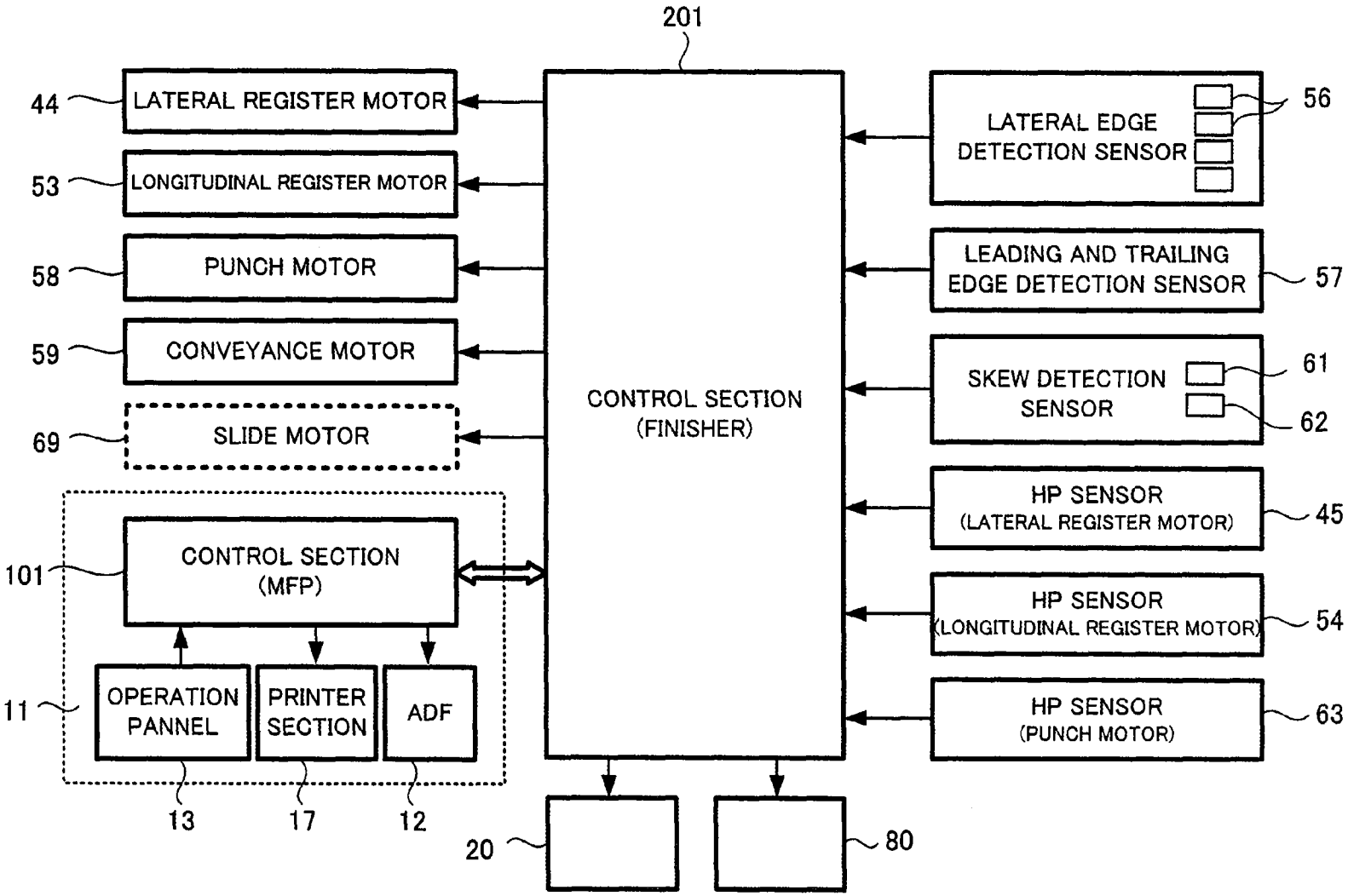
FIG. 5 is a block diagram of a control system of the sheet finishing apparatus.

The punching blade 36 is moved up and down by the rotation of a punch motor 58 (FIG. 5). The punching blade 36 is moved down in a paper surface direction of the sheet S, so that the punch hole can be punched in the sheet S.

The puncher 35A can be moved in an arrow A direction (lateral direction) orthogonal to the conveyance direction Z of the sheet S, and one end (lower end of the drawing) of the puncher 35A rotates in an arrow B direction along the conveyance direction of the sheet S.

Protrusions 37 and 38 are respectively provided at both ends of the puncher 35 in the axial direction, and long holes 39 and 40 are formed in the protrusions 37 and 38. A rack 41 is formed on the side surface of the one protrusion 37. A fixed shaft 42 provided at the main body side is fitted in the long hole 39 of the protrusion 37. Accordingly, the puncher 35A can be moved in the arrow A direction within the range of the length of the long hole 39 while the fixed shaft 42 is used as a guide.

A gear group 43 that engages with the rack 41 and rotates moves the puncher 35A in the lateral direction (A direction). A lateral register motor 44 rotates the gear group 43.

Further, there is a sensor 45 at a position separate from the protrusion 37. The sensor 45 is for detecting that the puncher 35A moves in the arrow A direction and reaches a home position (hereinafter also called an HP). The protrusion 37 is provided with a shutter 46 extending in the direction of the sensor 45, and when the shutter 46 crosses the sensor 45, the sensor detects that the puncher 35A moves to the home position in the A direction.

On the other hand, a fan-shaped cam 47 for rotating the puncher 35A in the arrow B direction is coupled to the protrusion 38 of the puncher 35A. The cam 47 rotates around a shaft 48, as a fulcrum, provided at the main body side of the finisher 200. The cam 47 has a lever 49 at one end and a gear 50 at the other end. The lever 49 is provided with a shaft 51, and the shaft 51 is fitted in the long hole 40 of the protrusion 38.

Besides, in order to rotate the puncher 35A in the longitudinal direction (B direction), a gear group 52 that engages with the gear 50 and rotates is provided, and a longitudinal register motor 53 to rotate the gear group 52 is provided. The cam 47 is rotated by the rotation of the longitudinal register motor 53, the lever 49 is rotated by that, and the puncher 35A is rotated in the longitudinal direction (B direction) around the fixed shaft 42 as the fulcrum.

Further, there is a sensor 54 at a position separate from the cam 47. The sensor 54 detects that the puncher 35A rotates in the arrow B direction and rotates to the home position. The cam 47 is provided with a shutter 55 extending in the direction of the sensor 54. The shutter crosses the sensor 54 if the puncher 35A is rotated to the home position.

In this way, the puncher 35A can be moved in the lateral direction (A direction) by the rotation of the lateral register motor 44, and can be rotated in the longitudinal direction (B direction) by the longitudinal register motor 53.

A movement mechanism 301 is for moving the puncher 35A in the lateral direction (arrow A direction), and a posture control mechanism 302 rotates the puncher 35A in the longitudinal direction (arrow B direction) to control the posture. The lateral direction movement mechanism 301 and the longitudinal direction posture control mechanism 302 constitute a drive mechanism to vary the position and the inclination angle of the puncher 35A.

A stepping motor whose rotation speed can be controlled by a pulse number or a frequency may be used as the lateral register motor 44 and the longitudinal register motor 53. A movement distance of the puncher 35A in the lateral direction can be controlled by the pulse number when the lateral register motor 44 is driven. Similarly, the rotation control of the puncher 35A, that is, the angle can be controlled by the pulse number when the longitudinal register motor 53 is driven.

Besides, at the sheet S carry-in side of the puncher 35A, a sensor group 56 is provided to detect an edge (lateral edge) of the sheet S in the lateral direction, and further, a sensor 57 is provided to detect an edge (leading edge and trailing edge) in the longitudinal direction when the sheet S is conveyed.

In the sensor group 56 and the sensor 57, for example, a light emitting element and a light receiving element are disposed to be opposite to each other, and when the sheet S is conveyed, the sheet S passes between the light emitting element and the light receiving element, so that the lateral edge, the leading edge and the trailing edge of the sheet S are detected.

On the other hand, the skew detection section 60 includes sensors 61 and 62 for detecting a skew. Each of the sensors 61 and 62 also includes, for example, a light emitting element and a light receiving element opposite to the light emitting element. The sensors 61 and 62 detect the skew of the sheet S passing between the light emitting element and the light receiving element.

The sensors 61 and 62 are disposed upstream of the punch unit 30. The sensors 61 and 62 detect the passing of the leading edge and the trailing edge of the sheet S. As shown in FIG. 4, the sensor 61 and the sensor 62 are disposed inside the minimum width size area of the sheet S having the minimum sheet width in which punching can be performed, are separate from each other by a distance L0, and are provided perpendicularly to the sheet conveyance direction.

Detection signals from the sensors 61 and 62 are sent to an after-mentioned control section. Timer counters are provided in the control section, and when the sensors 61 and 62 detect the passing of the leading edge of the sheet S, the respective timer counters start to count. For example, when the sheet S is not inclined with respect to the conveyance direction at all, since the sensors 61 and 62 simultaneously detect the passing of the leading edge of the sheet S, the respective timer counters simultaneously start to count, and a timer difference does not occur.

On the other hand, when the sheet S is skewed and is conveyed, a time difference occurs in the passing of the sheet S detected by the first sensor 61 and the second sensor 62. A skew of the sheet S can be detected by observing the time difference.

The sheet S is inclined obliquely, and for example, when the sensor 61 first detects the sheet S, and then, the sensor 62 detects the sheet S, a skew error distance (a) can be obtained from the time difference of the detection and the conveyance speed V. When the distance between the first sensor 61 and the second sensor 62 is L0, and a skew angle is θ, a following expression (1) is established.

$$a = L0 \cdot \tan\theta \quad (1)$$

When the skew angle θ is obtained from the expression (1), the longitudinal register motor 53 is rotated by the angle θ to incline the puncher 35A, and skew correction is performed according to the skew amount of the sheet.

A conveyance roller 34 is driven by a conveyance motor 59, and conveys the sheet S conveyed from the upstream side (inlet side to the punch unit 30) to the downstream side (outlet side of the punch unit 30) at a conveyance speed V. The conveyance motor 59 is rotated at, for example, a constant rotation speed.

A control system of the finisher 200 will be described with reference to a block diagram of FIG. 5.

In FIG. 5, a control section 201 controls the finisher 200 and includes a CPU (Central Processing Unit), a RAM, a ROM and the like. The control section 201 is connected with the sensor group 56 for lateral edge detection, the sensor 57 for detecting the leading edge and trailing edge of the sheet S, the sensors 61 and 62 for skew detection, and the home position sensors 45, 54 and 63. The detection results from the respective sensors are inputted to the control section 201.

Besides, the control section 201 is connected with the lateral register motor 44, the longitudinal register motor 53, the punch motor 58, and the conveyance motor 59. The control section 201 controls the rotation of the respective motors in response to the detection results of the various sensors.

The home position sensor 45 detects the home position when the puncher 35A is moved in the lateral direction (A direction) by the lateral register motor 44. The home position in the lateral direction is the center of the conveyance path of the sheet S.

The home position sensor 54 detects the home position when the puncher 35A is rotated in the longitudinal direction (B direction) by the longitudinal register motor 53. The home position in the longitudinal direction is the position where puncher 35A is most inclined.

Further, the home position sensor 63 detects the home position when the punching blade 36 is moved up and down by the punch motor 58. The home position of the punching blade 36 is a state where the punching blade 36 is pulled out from the sheet S, that is, a position where the punching blade 36 is separate from the paper surface of the sheet S.

Further, the control section 201 is connected to a control section 101 to control the main body (MFP) 11. The control section 101 is connected with the respective sections of the main body 11, for example, the operation panel 13, the printer section 17, the ADF 12 and the like. The control section 201 controls the staple unit 20 and the saddle unit 80 as described before.

The control section 201 and the control section 101 operate in cooperation with each other, and issue a stapling instruction and a punching instruction by the operation of the operation panel 13. Besides, a folding instruction, and a punching instruction at folding are issued. Further, a designation of a sheet size, an instruction for the number of copies and the like are issued by the operation of the operation panel 13.

The basic operation of the punch unit 30 will be described with reference to FIGS. 6A and 6B. FIG. 6A shows an initial state of the punch unit 30. When receiving a punching instruction from the main body 11, the control section 201 drives the longitudinal register motor 53, rotates the puncher 35A in the arrow B1 direction along the conveyance direction of the sheet S, and sets the puncher 35A in an inclined state. This state is the home position in the longitudinal direction.

Besides, the control unit 201 drives the lateral register motor 44, moves the puncher 35A in an arrow A1 direction crossing the conveyance direction of the sheet S by the gear group 43, and sets the puncher 35A at a retract position.

Thereafter, when the sheet S is carried in, the skew detection section 60 detects the skew amount of the leading edge of the sheet S. When the skew amount is detected, the control unit 201 drives the longitudinal register motor 53, and inclines the puncher 35A in an arrow B2 direction in accordance with the skew amount of the sheet S as shown in FIG. 6B.

Figure 6B:
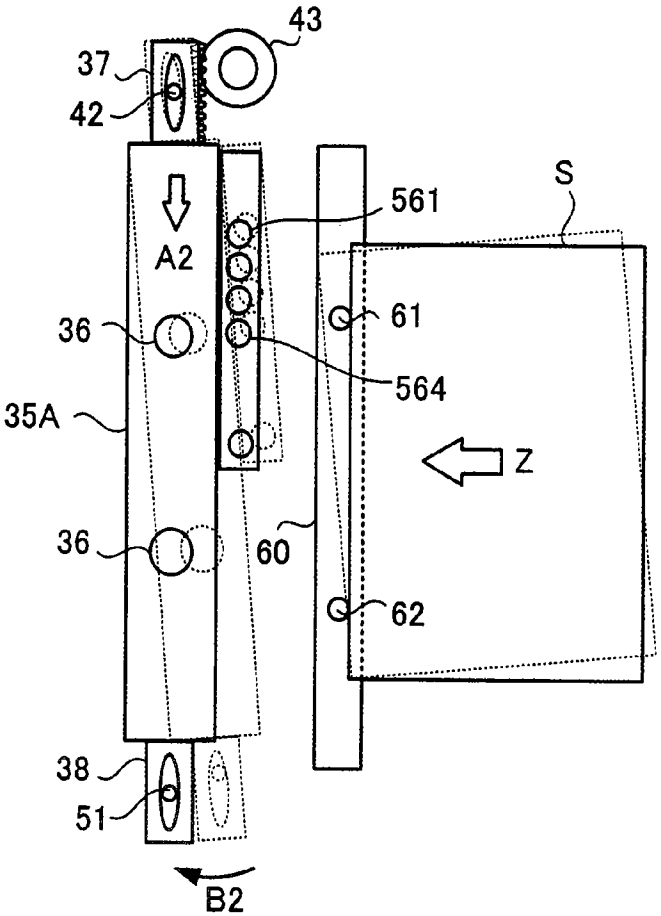
FIG. 6A and FIG. 6B are plan views showing a basic operation of the punch unit.
Figure 6A:
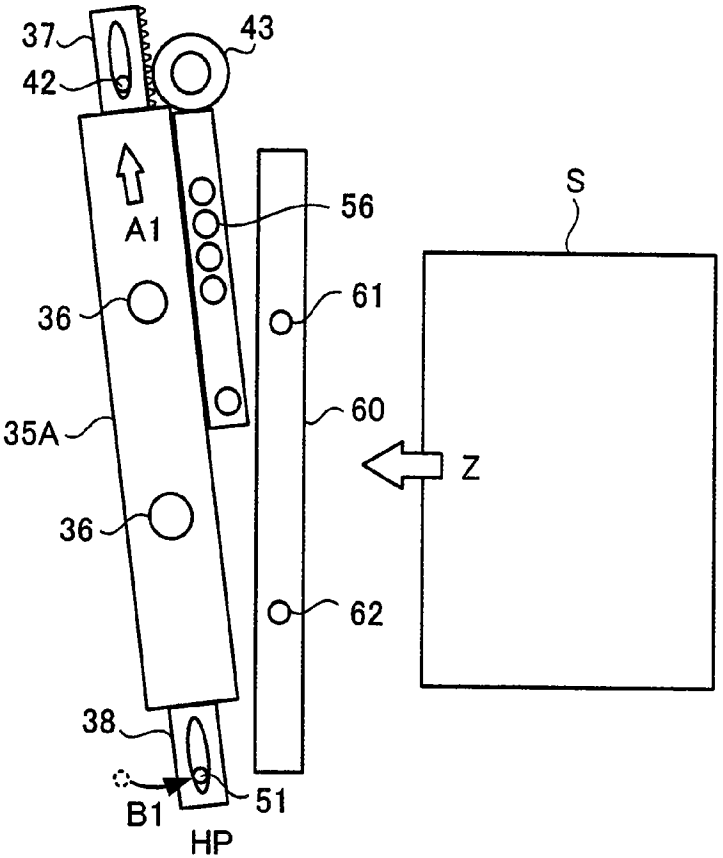

A thin dotted line of FIG. 6B shows a state where the puncher 35A is inclined in accordance with the skewed sheet S. When the sheet S is not skewed, as indicated by a solid line, the puncher 35A is orthogonal to the conveyance direction of the sheet S.

Next, when the sensor 57 detects the leading edge of the sheet S and detects that the sheet S is conveyed by a specified amount, the lateral register motor 44 is driven, and the puncher 35A is moved in an arrow A2 direction from the retract position to the center of the conveyance path. At the stage of the movement, the sensor group 56 detects the lateral edge of the sheet S along the conveyance direction.

In the lateral edge detection, a certain sensor in the sensor group 56 is specified according to the sheet size instructed by the operation panel 13, and detection is performed by the specified sensor. For example, an outside sensor 561 is used to detect the lateral edge of the A4 size. When the sheet size is small, an inside sensor 564 is used to detect the sheet size. When the lateral edge is detected by a certain sensor of the sensor group 56, the lateral register motor 44 is stopped and the movement of the puncher 35A is also stopped.

Thereafter, when the sheet S is conveyed to a specified position, the conveyance motor 59 is stopped. In this state, the punch motor 58 is driven to move the punching blade 36 downward and punching is performed on the sheet S.

When the punching is ended, the control section 201 again drives the conveyance motor 59 and discharges the sheet S. When there is a next sheet, a similar process is repeated, and when there is no subsequent sheet, the respective devices are set at the home position (HP). In this way, when the sheet S is skewed, the puncher 35A is inclined according to the skew amount and punching is performed.

When the punching is performed on the sheet S, the position of the punching varies between when the sheet S is folded and when the sheet is not folded. When not folded, the punching is performed at a position close to the trailing edge of the sheet S in the conveyance direction, and when folded, the punching is performed at, for example, two positions symmetrical with respect to the fold center of the sheet S.

Figure 7A:
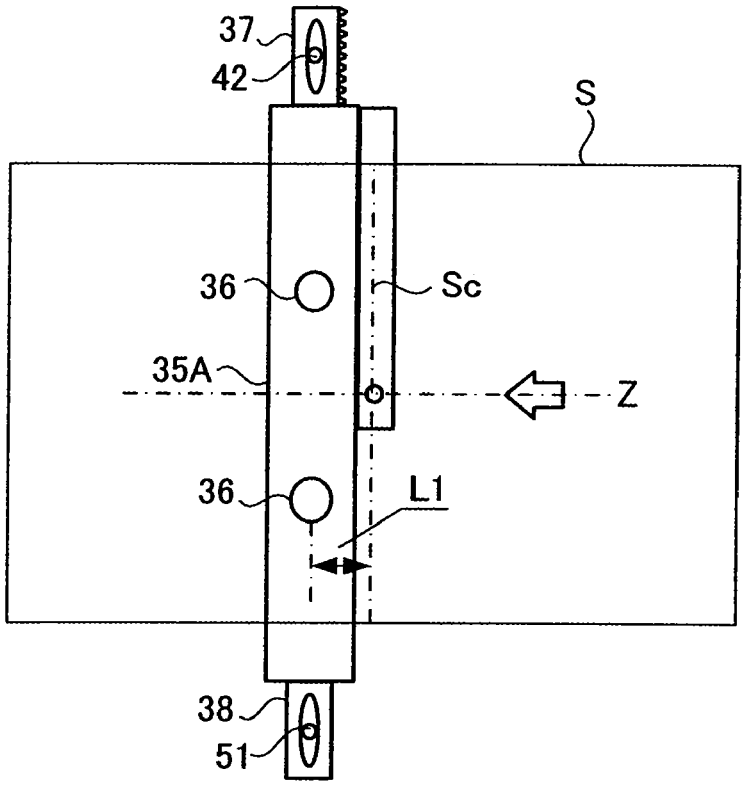
FIG. 7A and FIG. 7B are plan views showing another operation of the punch unit.
Figure 7B:
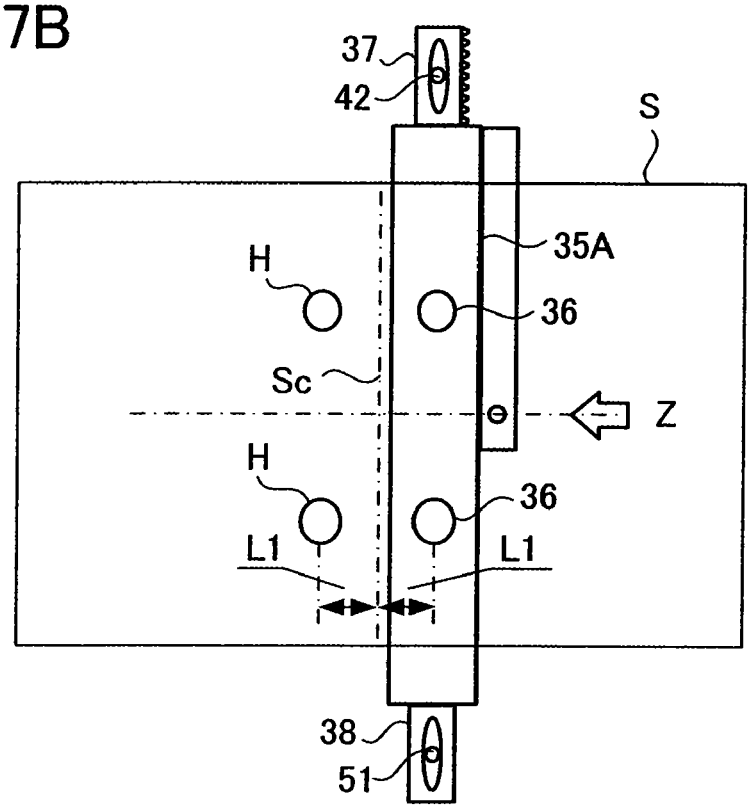

FIGS. 7A and 7B are views for explaining the operation of the case where punching is performed before the sheet S is folded. FIGS. 7A and 7B show states where the sheet S is normally conveyed and there is no skew, and show the case where folding is performed at a center line Sc of the sheet S. A position where a fold of the sheet S is formed is called a folding line. In FIGS. 7A and 7B, the center line Sc corresponds to the folding line.

As shown in FIG. 7A, when the sheet S is conveyed and the center line Sc reaches a position in front of the puncher 35A, the conveyance of the sheet S is once stopped, the punching blade 36 of the puncher 35A is moved down, and first punching is performed on the sheet S. As shown in FIG. 7B, when the sheet S is slightly conveyed, the conveyance of the sheet S is once stopped, the punching blade 36 of the puncher 35A is moved down, and second punching is performed on the sheet S.

When the second punching is ended, the sheet S is discharged, and the puncher 35A waits for a next sheet S. In this way, the punch holes H are punched in the sheet S at positions symmetrical with respect to the center line Sc. In FIG. 7B, an interval between the center line Sc and the punch hole H of the sheet S is denoted by L1.

When the number of sheets S becomes large and the sheet bundle becomes thick, a relative position is shifted between the punch hole of the sheet at the front cover side of the folded sheet bundle and the punch hole of the inside sheet. Thus, as the number of sheets. S increases, the punching position is shifted little by little, and punching is performed at a position departing from the center line Sc.

Figure 8A:
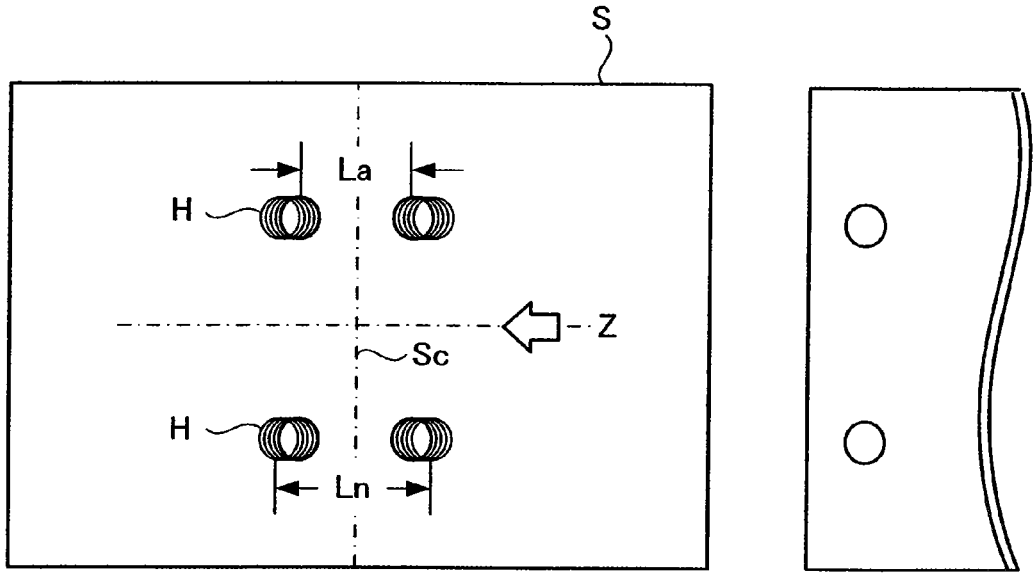
FIG. 8A and FIG. 8B are plan views showing an operation of formation of a punch hole.

FIG. 8A shows a state where the position of the punch hole H of the sheet S is shifted little by little with respect to the center line Sc. When punching is performed on plural sheets S, when an interval between the punch holes at the inside of the sheet bundle is La, and an interval between the punch holes at the front cover side is Ln, the puncher 35A changes the punching position so that the interval between the punch holes becomes gradually wide so as to establish a relation of La<Ln.

The control section 201 controls the timing of the conveyance of the sheet S and the moving down of the punching blade 36, and controls the punching position so that the interval between the center line Sc and the punch hole H becomes small toward the inside of the sheet bundle and becomes large toward the front cover side. Accordingly, when the sheet bundle is folded as shown in the right of FIG. 8, the positions of the respective punch holes H are aligned.

Figure 8B:
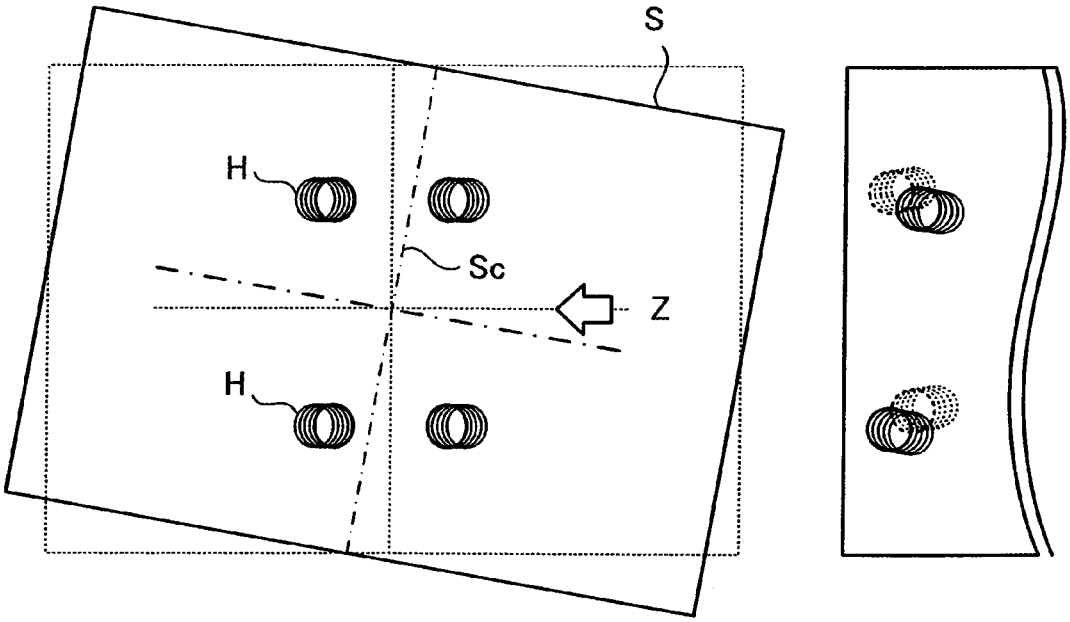

On the other hand, when the sheet S is inclined obliquely with respect to the puncher 35A and is conveyed, as shown in FIG. 8B, the punch holes H are punched at positions asymmetric with respect to the center line Sc of the sheet S. Thus, when the sheet bundle is folded, as shown in the right of FIG. 8B, the positions of the punch holes of the respective sheets S are largely shifted, and the sheet bundle can not be stitched.

Then, in order not to shift the positions of the punch holes of the respective sheets S largely, when the sheet is folded, the position of the punch hole is sequentially shifted while the center line Sc of the sheet S is made the center, the skew amount of the sheet S is detected, and the inclination and the position of the puncher 35A are changed according to the detected skew amount.

When a booklet is bound, before the sheet S is folded, punching is performed while the center line Sc is made the center. A description will be given to an example where punching is performed using one puncher 35A and an example where punching is performed using a twin puncher.

Figure 9A:
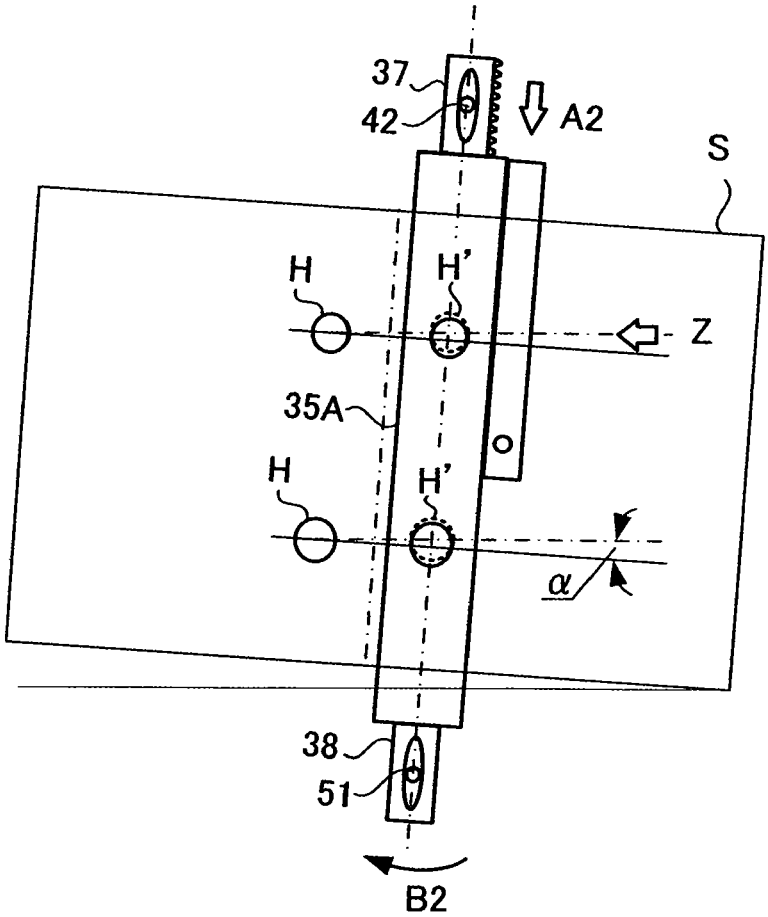
FIG. 9A and FIG. 9B are plan view showing a skew correction of the punch unit and an operation of punching.
Figure 9B:
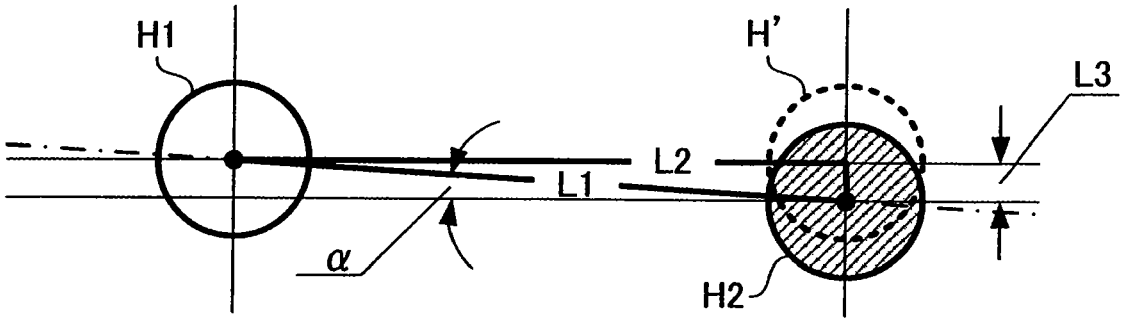

FIG. 9A and FIG. 9B show the example where the one puncher 35A is used. In FIG. 9A, similarly to FIGS. 7A and 7B, after first punching is performed, second punching is performed at a position symmetrical with respect to the center line Sc of the sheet S.

When the sheet S is obliquely inclined and is conveyed, the puncher 35A is made parallel to the leading edge of the sheet S according to the skew amount detected by the skew detection section 60.

FIG. 9A shows a state where the sheet S is inclined by an angle α and is conveyed. The puncher 35A is inclined in a direction of an arrow B2, and is orthogonal to the leading edge of the sheet S. The punch holes H are punched at almost symmetrical positions with respect to the center line Sc of the sheet S.

However, after the first punching is performed, since the sheet S is conveyed along an alternate long and short dash line Z, the second punching is performed at a position on the alternate long and short dash line Z. Accordingly, as indicated by a dotted line H', the position of the punch hole is shifted. Then, when the second punching is performed, the puncher 35A is moved in the arrow B2 direction by the movement mechanism 301.

In FIG. 9B, H1 denotes the punch hole by the first punching, and H2 denotes the normal position of the second punch hole. Besides, H' denotes the shifted punch hole (H' of FIG. 9A). A normal distance interval between the punch holes H1 and H2 is L1, an actual conveyance distance from the first punching position to the second punching position is L2, and a movement distance of the puncher 35A in the arrow A2 direction is L3.

Since the distance L2 is the actual conveyance distance, and the distance L1 is a previously set value, the distance L2 can be calculated based on an angle α, and the movement distance L3 can be calculated from an expression (2).

$$L3=L2\cdot\tan\theta \quad (2)$$

Accordingly, when the second punching is performed by the puncher 35A, the control section 201 controls the lateral register motor 44 to move the puncher 35A by the distance L3, and the punching is performed. By this, the punch hole H2 can be punched at the normal position.

Figure 10A:
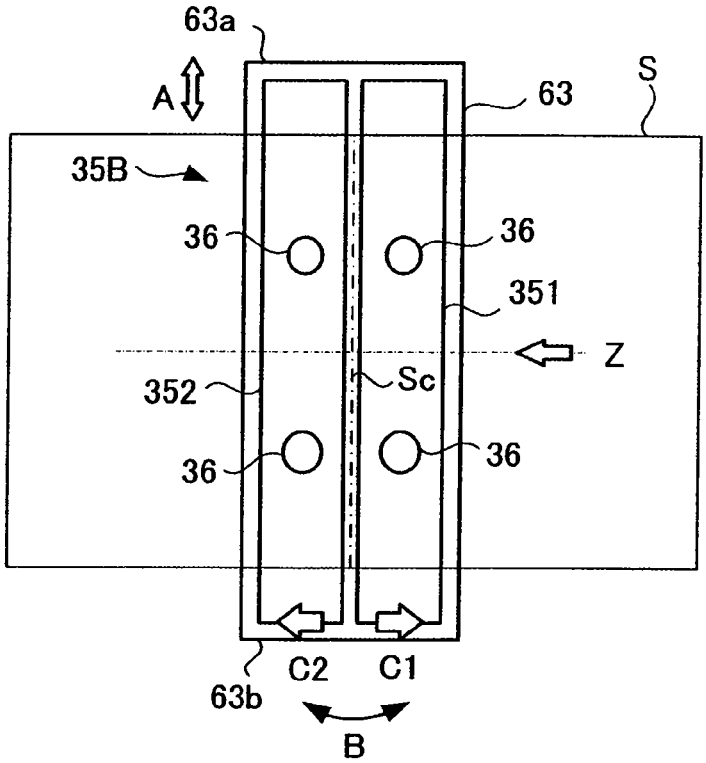
FIG. 10A and FIG. 10B are plan views showing an operation of a twin punch unit.
Figure 10B:
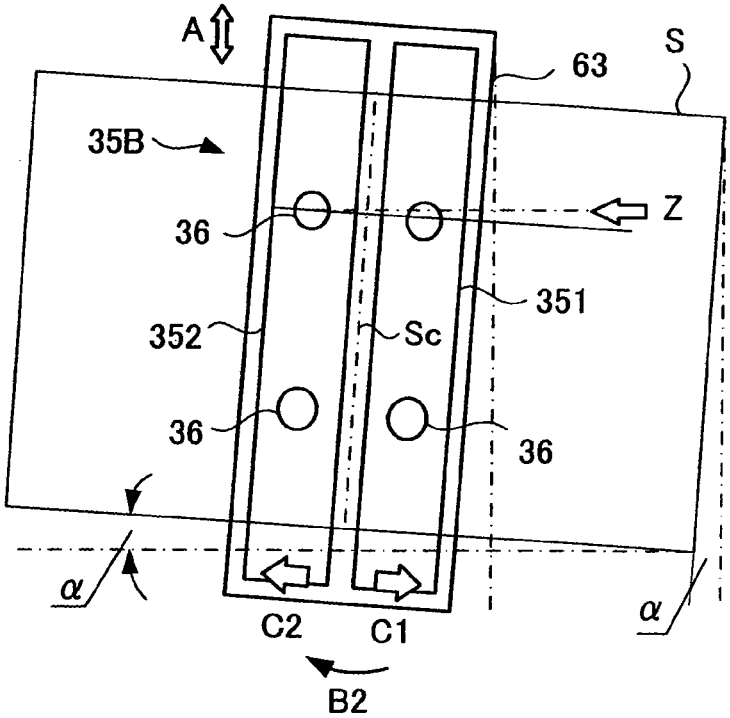

FIGS. 10A and 10B are views showing a basic structure of a twin puncher 35B. In FIG. 10A, the puncher 35B is such that a first and a second punchers 351 and 352 are attached to a base 63, and four punch holes H are simultaneously punched in a sheet S by punching blades 36 provided in the punchers 351 and 352. Each of the punchers 351 and 352 is identical to the puncher 35A of FIG. 4.

In order to adjust an interval between the punchers 351 and 352, the punchers 351 and 352 are attached to the base 63 so as to be slidable in directions of arrows C1 and C2, respectively.

The base 63 moves in an A direction orthogonal to the conveyance direction Z of the sheet S. The base 63 rotates such that one end 63*a* is made a fulcrum and the other end 63*b* rotates in an arrow B direction, so that a skew correction can be performed.

Accordingly, when the sheet S is inclined and conveyed, as shown in FIG. 10B, the base 63 is inclined according to an inclination angle α, so that the skew correction can be performed. Besides, the base 63 can be moved in the arrow A direction according to the position shift of the conveyed sheet S in the lateral direction.

When four holes are punched in the sheet S, punching is performed at positions axisymmetric with respect to the center line Sc of the sheet S. Besides, the punchers 351 and 352 are gradually shifted in directions of arrows C1 and C2 so that when punching is performed on a sheet at the inside of a sheet bundle, an interval between the puncher 351 and the puncher 352 is made small, and when punching is performed on a sheet at the front cover side of the sheet bundle, the interval between the puncher 351 and the puncher 352 is made wide.

By this, even if the sheet bundle becomes thick, the positions of the punch holes when folding is performed can be aligned with high precision.

Figure 11:
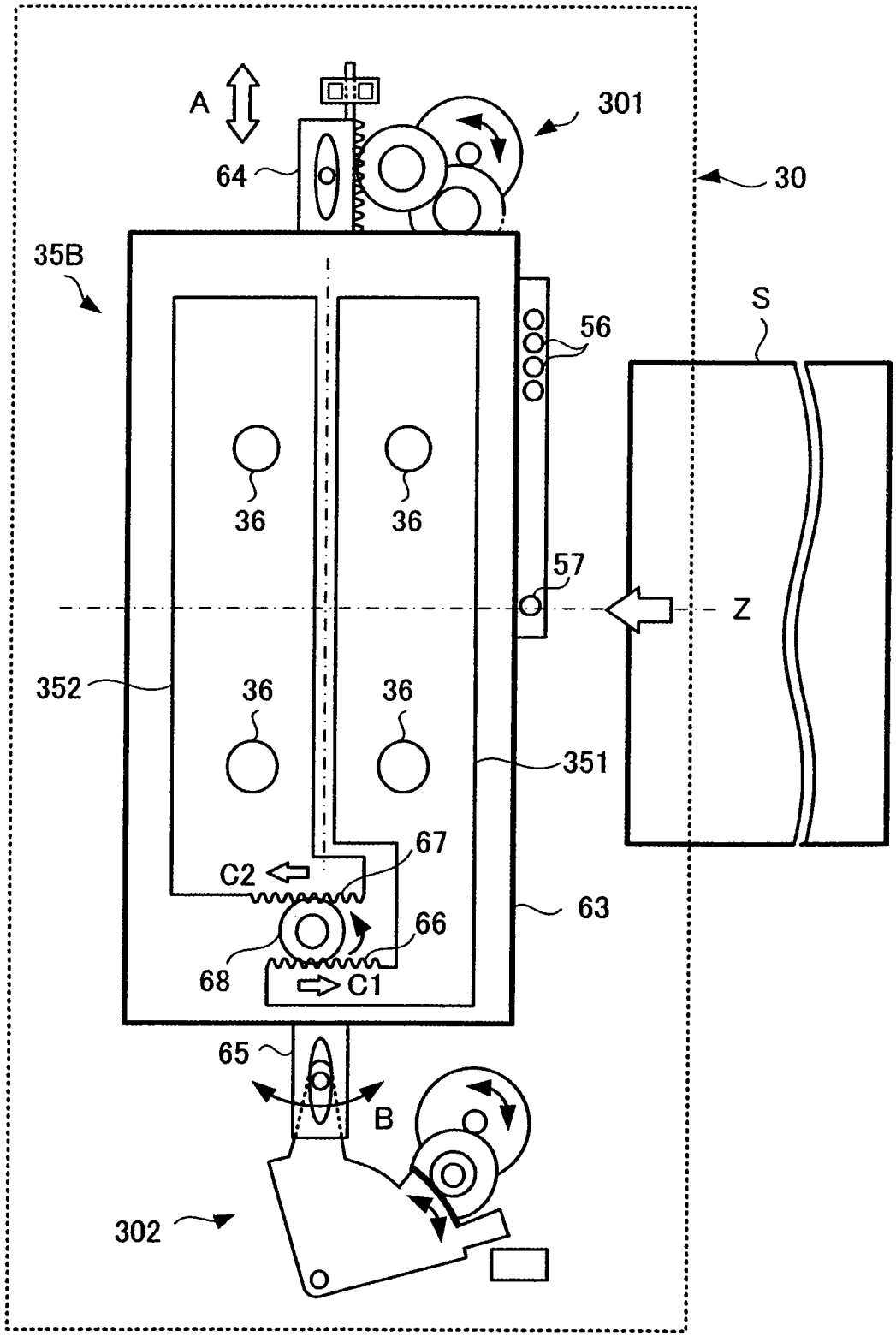
FIG. 11 is a plan view of the twin punch unit.

FIG. 11 is a plan view showing a specific structure of the twin puncher 35B. In FIG. 11, projections 64 and 65 are respectively provided at both ends of the base 63 in the axial direction. A movement mechanism 301 similar to that of FIG. 4 is disposed at the projection 64 side, and a posture control mechanism 302 is disposed at the projection 65 side. The operation of the movement mechanism 301 and the posture control mechanism 302 are as described in FIG. 4.

On the base 63, the first and the second punchers 351 and 352 are supported in parallel with each other and to be orthogonal to the conveyance direction Z of the sheet S. Racks 66 and 67 are respectively provided at one ends of the first and the second punchers 351 and 352 while the first and the second punchers 351 and 352 are spaced from each other. A gear 68 is engaged with the respective racks 66 and 67. The gear 68 is rotated by a slide motor 69 (FIG. 5), and can slide the punchers 351 and 352 in a direction of approaching each other or going away from each other (C1 or C2 direction).

Accordingly, four punch holes H can be simultaneously punched at positions symmetrical with respect to the center line Sc of the sheet S. Besides, the punchers 351 and 352 are slid in the arrow C1 or C2 direction, so that the positions of the right and left punch holes can be shifted.

One of the first and the second punchers 351 and 352 may be fixed, and only the other may be slid. In this case, the sliding distance becomes long.

Figure 12:
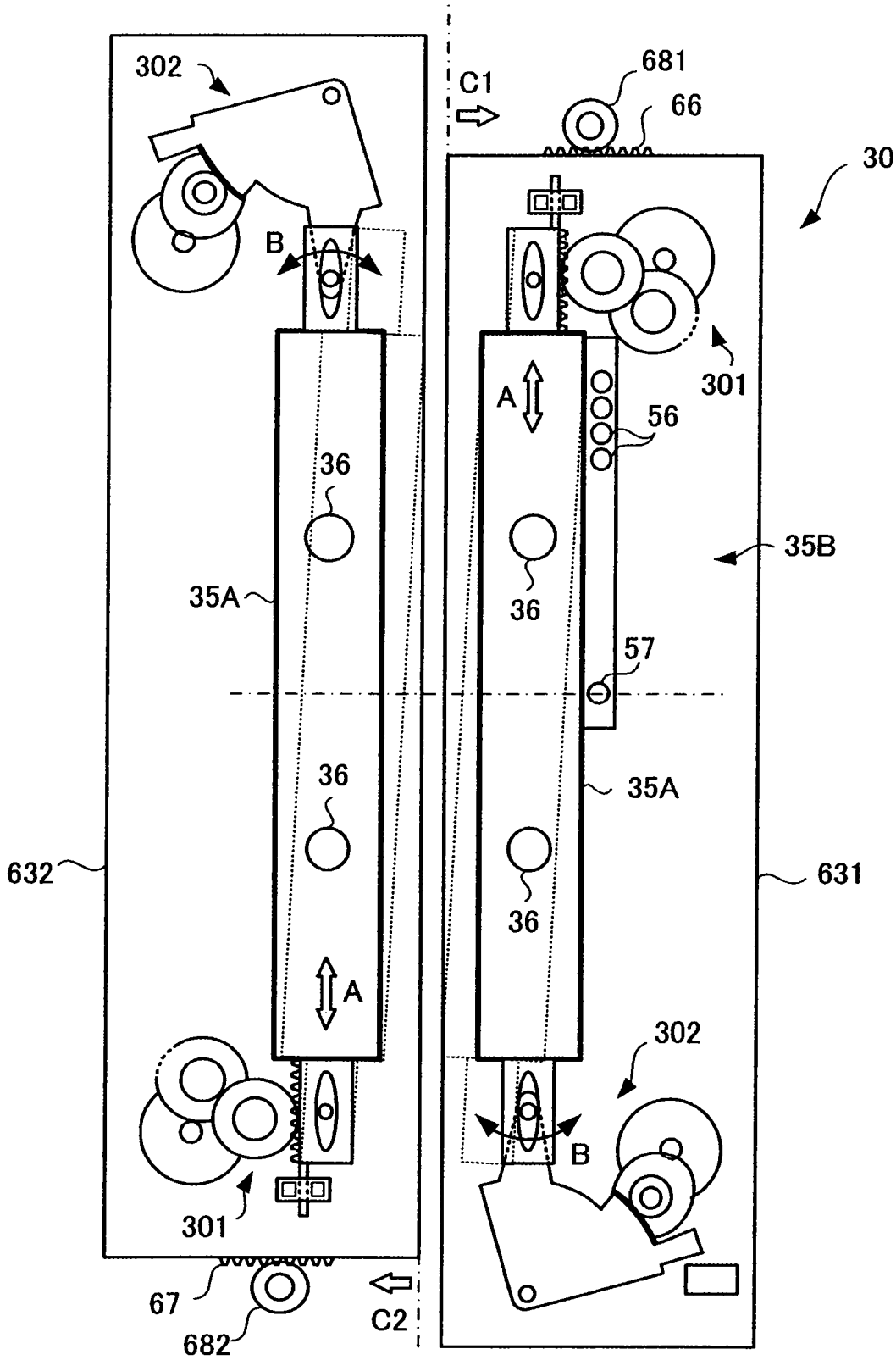
FIG. 12 is a plan view of another embodiment of the twin punch unit.

The structure of the twin puncher 35B is not limited to the example of FIG. 11, but may be a structure shown in FIG. 12. In FIG. 12, two punchers 35A each of which is shown in FIG. 4 are arranged. In this example, the two punchers 35A are respectively attached to bases 631 and 632, and the up-and-down directions of the two punchers 35A are made opposite to each other. By this, the punchers 35A can be disposed while the distance between two punchers 35A is made short.

Besides, in order to slide the bases 631 and 632 in directions of arrows C1 and C2, a rack 66 is formed on the base 631, a rack 67 is formed on the base 632, and gears 681 and 682 are provided so as to engage with the respective racks 66 and 67. The gears 681 and 682 are rotated by motors (not shown), so that the bases 631 and 632 can be slid in the directions of the arrows C1 and C2.

The two punchers 35A share one skew detection section 60 (FIG. 4) to control the inclination (posture), and are inclined in the same direction as indicated by dotted lines, and also share sensors 56 and 57 to perform movement control in the lateral direction (A direction).

In the twin puncher 35B, a lateral direction movement mechanism 301, a longitudinal direction posture control mechanism 302 and a slide mechanism constitute a movable mechanism to vary the position and the inclination angle of the puncher (351, 352, 35A).

A next embodiment will be described.

The next embodiment includes a press unit 70 to suppress the flapping of a sheet S or the warp of the sheet when the sheet is conveyed to a punch unit 30.

Figure 13:
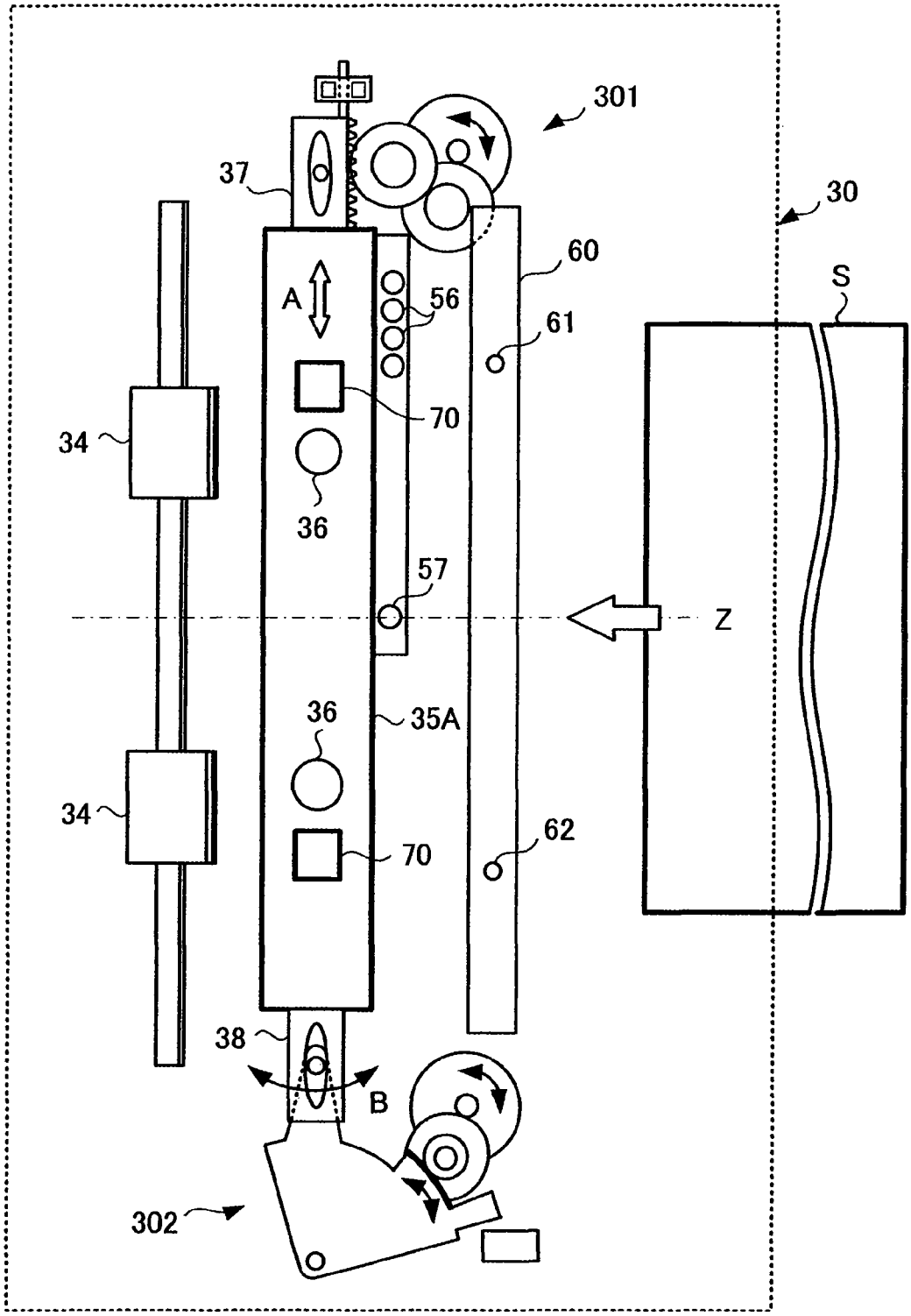
FIG. 13 is a plan view of a punch unit.

FIG. 13 is a plan view showing the punch unit 30. The punch unit 30 of FIG. 13 includes the press unit 70. The structure of the punch unit 30 other than the press unit 70 is equal to that of FIG. 4.

The press unit 70 is separate from a punching blade 36 of a puncher 35A. The press unit 70 protrudes in the direction of the sheet S.

Figure 14:
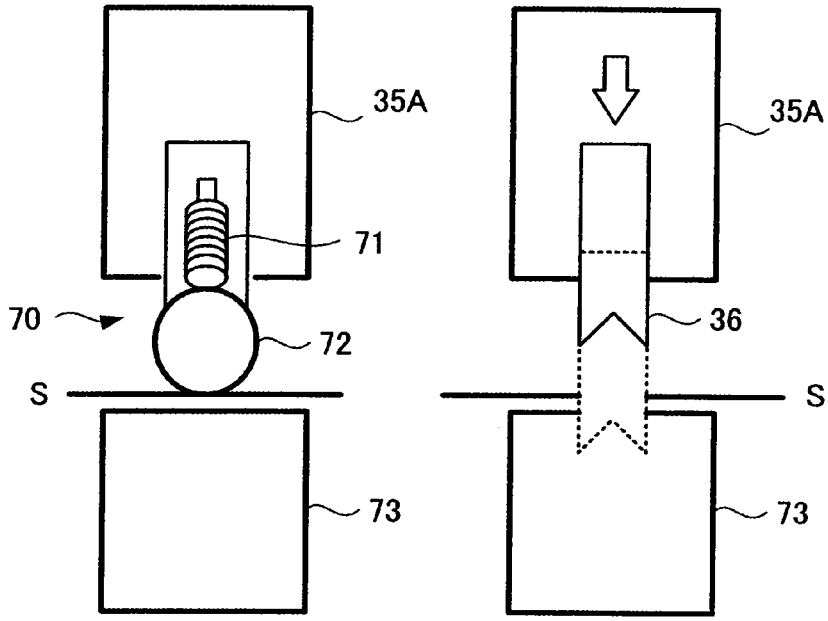
FIG. 14 is an explanatory view showing a basic operation of the punch unit.

FIG. 14 is a view for explaining the operation of the press unit 70 and the punching blade 36. The press unit 70 includes a ball-like press member 72 urged in the direction of the sheet S by a spring 71. The press member 72 presses the sheet S in the direction of a die 73. The die 73 is opposite to the punching blade 36.

The sheet S passes through a gap between the punching blade 36 of the puncher 35A and the die 73 and is conveyed. In order to suppress the flapping of the sheet S and the warp of the sheet S, the press member 72 presses the sheet S to the die 73 side. Accordingly, punch holes H can be punched at accurate positions when punching is performed.

When the press unit 70 is provided also in the vicinity of the punching blade 36 of the twin puncher 35B shown in FIG. 11, the flapping and the warp of the sheet S at punching can be suppressed.

Figure 15:
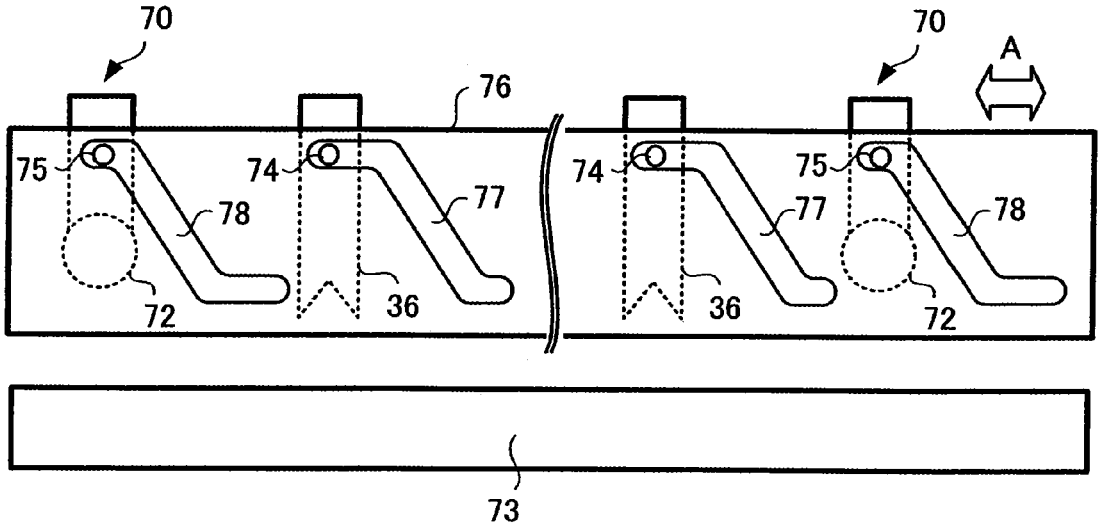
FIG. 15 is a front view of the punch unit.

FIG. 15 is a front view showing another embodiment of a press unit 70. The press unit 70 shown in FIG. 15 is moved up and down in accordance with the moving up and down of a punching blade 36 when a sheet S is conveyed to a puncher 35A.

In FIG. 15, the punching blade 36 and a press member 72 are respectively provided with protruding pins 74 and 75. The punching blade 36 and the press member 72 are supported by the puncher 35A to be capable of moving up and down.

The pin 74 is inserted in a cam hole 77 formed in a slide link 76, and the pin 75 is inserted in a cam hole 78 formed in the slide link 76. The slide link 76 is attached to the puncher 35A, and slides in an A direction orthogonal to the conveyance direction of the sheet S. The slide link 76 moves in the arrow A direction by using the rotation force of a punch motor 58 (FIG. 5). A gear, a rack and the like can be used to convert the rotation force of the punch motor 58 into the linear movement of the slide link 76.

When the slide link 76 is slid, since the positions of the pins 74 and 75 inserted in the cam holes 77 and 78 are moved in the up-and-down direction, the punching blade 36 and the press member 72 are moved up and down. The cam holes 77 and 78 have oblique surfaces inclined at the same angle, and have flat parts extending in parallel to the slide direction at the upper ends and the lower ends of the oblique surfaces. The cam hole 77 has the long flat part at the upper end and the short flat part at the lower end. The cam hole 78 has the short flat part at the upper end and the long flat part at the lower end.

Figure 16A:
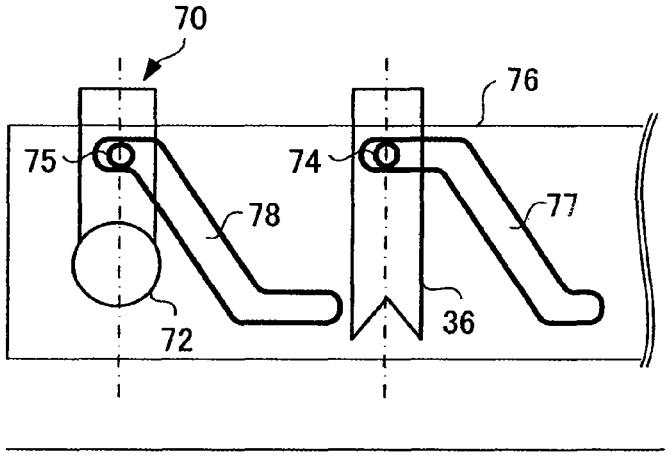
FIG. 16A, FIG. 16B and FIG. 16C are explanatory views of an operation of the punch unit.
Figure 16B:
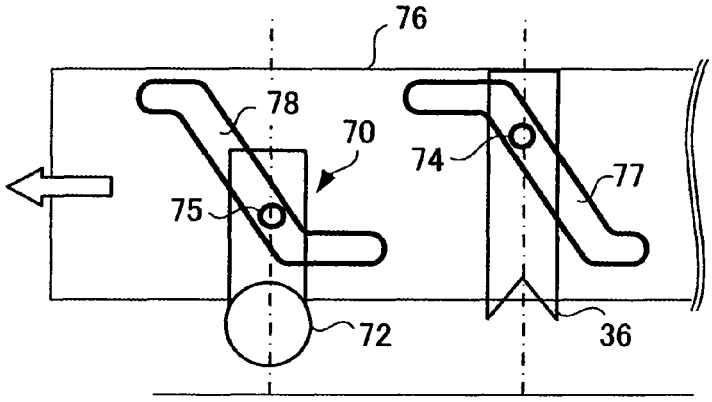
Figure 16C:
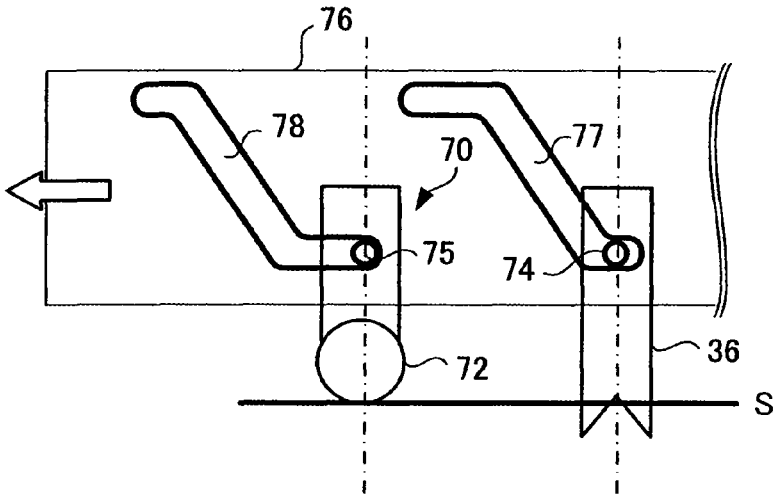

FIGS. 16A, 16B and 16C show the moving up and down operation of the punching blade 36 and the press member 72 when the slide link 76 slides.

In FIG. 16A, the slide link 76 is at a position where it slides to the right of the drawing. The pins 74 and 75 of the punching blade 36 and the press member 72 are at the depth sides of the upper end parts of the cam holes 77 and 78. This state is a home position of the punching blade 36 and the press member 72.

When the slide link 76 slides in an arrow direction (left direction), as shown in FIG. 16B, the press member 72 first moves down along the oblique surface of the cam hole 78, and slightly later, the punching blade 36 moves down along the oblique surface of the cam hole 77.

When the slide link 76 slides in the arrow direction (left direction), as shown in FIG. 16C, the press member 72 stops moving down at the position where the press member 72 presses the sheet S. Besides, since the punching blade 36 moves down slightly later than the press member 72, the punching blade 36 punches the sheet S after the press member 72 presses the sheet S.

When punching is ended, the slide link 76 slides in the opposite direction. The press member 72 rises after the punching blade 36 rises, and returns to the home position.

Accordingly, when the sheet S is punched, the press member 72 reaches the sheet S earlier than the punching blade 36, presses the sheet S to the surface of the die 73, and then, the punching blade 36 punches the punch holes in the sheet S. By this, even if the sheet S flaps or warps, the sheet S can be pressed to the die 73, and the punching can be performed at the accurate position.

A burr or breakage may not occur in the punch hole of the sheet S when the punching blade 36 is pulled out from the sheet S since the punching blade 36 is separated from the paper surface in the state where the press member 72 presses the sheet S.

In a recent MFP, the conveyance speed of the sheet is high and the sheet is likely to flap at punching. The press member 72 may presses the flapping of the sheet in punching the punch hole at the accurate position.

The moving up and down mechanism of the press member 72 and the punching blade 36 are not limited to the example shown in FIG. 15. The timing of the moving up and down of the press member 72 and the punching blade 36 can be arbitrarily set by deforming the shape of the slide link 76 or the shapes of the cam holes 77 and 78.

The present invention is not limited to the above embodiments, but can be variously modified within the scope not departing from the claims.

Although exemplary embodiments are shown and described, it will be apparent to those having skill in the art that a number of changes, modifications, or alterations as described herein may be made, none of which depart from the spirit. All such changes, modifications, and alterations should therefore be seen as within the scope.

What is claimed is:

1. A sheet finishing apparatus comprising:

a skew detector to detect a skew amount of a conveyed sheet;

a punch unit that includes a puncher disposed downstream of the skew detector and punches a hole in the sheet;

a drive mechanism to change a position of the puncher with respect to a conveyance path of the sheet and an inclination angle of the puncher with respect to the conveyance path of the sheet;

a saddle unit that is disposed downstream of the puncher and forms folds along folding lines of a plurality of the punched sheets; and a controller that drives the drive mechanism to change the position and the inclination angle of the puncher according to the detected skew amount and to punch holes at positions axisymmetric with respect to the folding line.

2. The apparatus of claim 1, wherein the punch unit includes one puncher having a plurality of punching blades, and the controller drives the punching blades of the one puncher and performs punching twice symmetrically with respect to the folding line of the sheet.

3. The apparatus of claim 2, wherein the controller controls to change the inclination angle of the one puncher according to the skew amount detected by the skew detector and to perform first punching, and after the sheet is conveyed by a specified distance, the controller controls to move the one puncher in a direction orthogonal to a conveyance direction of the sheet and to perform second punching.

4. The apparatus of claim 1, wherein the punch unit includes two punchers each having a plurality of punching blades, at least one of the two punchers slides in a direction parallel to a conveyance direction of the sheet, and the controller controls an interval between the two punchers to perform punching by driving the respective punching blades when the folding line of the sheet is positioned between the two punchers.

5. The apparatus of claim 4, wherein the two punchers slide in a direction of approaching each other and a direction of going away from each other.

6. The apparatus of claim 4, wherein one of the two punchers slides to change a distance from the other puncher.

7. The apparatus of claim 4, wherein when the sheet is inclined and is conveyed, the controller changes the inclination angles of the two punchers in a same direction according to the skew amount detected by the skew detector, moves the two punchers in a direction orthogonal to the conveyance direction of the sheet according to the skew amount, and drives the respective punching blades to perform punching.

8. The apparatus of claim 1, further comprising:

a stapler to staple a bundle of the sheets at the folding line.

9. A control method of a sheet finishing apparatus, comprising:

providing a punch unit that includes a puncher disposed to be orthogonal to a conveyance path of a sheet, and a drive mechanism to vary a position and an inclination angle of the puncher;

providing a saddle unit that is disposed downstream of the punch unit and folds the sheet;

detecting a skew amount of the conveyed sheet;

controlling the drive mechanism according to the detected skew amount to change the position and the inclination angle of the puncher with respect to the sheet;

controlling the puncher to form punch holes in the sheet at positions symmetrical with respect to a folding line, and to perform punching to cause an interval between the folding line of the sequentially conveyed sheet and the punch hole to become small at an inside of a bundle of the sheets and to become large at a front cover side; and bundling a plurality of the punched sheets and folding the plurality of the punched sheets by the saddle unit.

10. The method of claim 9, wherein the punch unit includes one puncher having a plurality of punching blades, the punching blades of the one puncher are driven to perform punching twice symmetrically with respect to the folding line of the sheet, and the punching is performed on the sequentially conveyed sheet to cause the interval between the folding line and the punch hole to become small at the inside of the bundle of the sheets and to become large at the front cover side.

11. The method of claim 10, wherein when the sheet is inclined and is conveyed, the inclination angle of the one puncher is changed according to the detected skew amount and first punching is performed, and after the sheet is conveyed by a specified distance, the one puncher is moved in a direction orthogonal to a conveyance direction of the sheet according to the skew amount and second punching is performed.

12. The method of claim 9, wherein the punch unit includes two punchers each having a plurality of punching blades, at least one of the two punchers slides in a direction parallel to a conveyance direction of the sheet, the respective punching blades are driven to perform punching when the folding line of the sheet is positioned between the two punchers, and with respect to the sequentially conveyed sheets, an interval between the two punchers is controlled to cause the interval between the folding line and the punch hole to become small at the inside of the bundle of the sheets and to become large at the front cover side.

13. The method of claim 12, wherein the two punchers can slide in a direction of approaching each other and a direction of going away from each other.

14. The method of claim 12, wherein one of the two punchers is slidable, and the one puncher is slid to relatively change a distance from the other puncher.

15. The method of claim 12, wherein when the sheet is inclined and is conveyed, the inclination angles of the two punchers are changed in a same direction according to the detected skew amount, and the two punchers are moved in a direction orthogonal to the conveyance direction of the sheet according to the skew amount, and the respective punching blades are driven to perform punching.

* * * * *